United States Patent [19]

Hashimoto et al.

[11] 4,007,302

[45] Feb. 8, 1977

[54] CASE-HARDENING METHOD FOR CARBON STEEL

[75] Inventors: Hiroshi Hashimoto, Chiba; Takeo Taniuchi, Tokyo; Kiyomitsu Suga, Kawaguchi; Toshio Shimizu, Tokyo, all of Japan

[73] Assignee: Kabushiki Kaisha Daini Seikosha, Japan

[22] Filed: Feb. 11, 1975

[21] Appl. No.: 548,975

[30] Foreign Application Priority Data

June 25, 1974 Japan ..... 49-71896

[52] U.S. Cl. ..... 427/249; 427/253; 427/399; 148/14

[51] Int. Cl.[2] ..... C23F 11/08; C23F 9/02

[58] Field of Search ..... 427/249, 228, 399, 253, 427/252; 148/14, 16

[56] References Cited

UNITED STATES PATENTS

| | | | |
|---|---|---|---|
| 2,685,545 | 8/1954 | Sindeband | 427/259 X |
| 2,962,399 | 11/1960 | Ruppert et al. | 427/249 |
| 3,579,373 | 5/1971 | Pingel | 427/249 |

FOREIGN PATENTS OR APPLICATIONS

| | | | |
|---|---|---|---|
| 236,033 | 7/1925 | United Kingdom | 427/399 |

*Primary Examiner*—Ralph S. Kendall
*Attorney, Agent, or Firm*—Robert E. Burns; Emmanuel J. Lobato; Bruce L. Adams

[57] ABSTRACT

A case-hardening method for carbon steel useful in the cementation thereof by the solid powder method is provided which involves forming a powder mixture of titanium powder, chromium oxide powder and a catalyst which is a halogenated salt, embedding carbon steel in said powder mixture and subjecting the resultant mixture to a heat treatment to form thereby a carbide hardened layer composed mainly of titanium carbide.

8 Claims, 6 Drawing Figures

CASE-HARDENING METHOD FOR CARBON STEEL

This invention relates to metallic cementation for infiltrating and diffusing a metal element in the surface of carbon steel, and more particularly to a case-hardening method for forming a hardened layer mainly composed of titanium carbide and having high toughness and hardness according to a solid powder method.

Heretofore, titanium carbide case-hardening has been generally practiced by using the so-called vapor-phase method. According to this method, titanium halide (principally $TiCl_4$) and hydrocarbon gas are used as the titanium source and they are fed into a reactor in which an article to be treated is set, by using hydrogen gas as a carrier, and a substitution and reduction reaction is performed in the reactor at a high temperature of approximately 1,000° to 1,100° C so as to precipitate titanium carbide TiC in the surface of the treated article. The TiC layer obtained from this method has extremely high hardness on the order of 3,000 to 4,000 in micro-Vickers hardness (Hv), and it is used as an excellent anti-wear surface material, for instance, on the molds made of dies steel or such. It ensures a life of the article several times longer as compared with articles merely made of ordinary hardened steel. This method, however, requires gas-doping equipment and a reactor, and a good deal of care is necessary for gas control as the qualities of the worked layer, such as thickness, hardness and surface roughness of the coating layer, are directly affected by the mode of composition control of the feed gas containing hydrogen $H_2$, propane $C_3H_8$, titanium tetrachloride $TiCl_4$ and such. Further, as corrosive gas is used in the process, it is necessary to provide in the reactor a chamber formed from a non-metal such as silicon oxide $SiO_2$, resulting in an elevated manufacturing cost of the apparatus. Also, the thickness of the processed layer formed by this method may vary according to the difference in location at which the work is set in the reactor, and adjustment of such layer thickness is attended by great difficulties. Further, non-uniformity in thickness of the treated layer gives rise to a difference in the coefficient of thermal expansion in each part of the work to cause undesirable deformation in the work.

On the other hand, according to the chromizing method which has also been commonly used in the industries, metallic chromium or ferrochromium is used as chromium source and this is mixed with calcined alumina used for inhibiting powder deposition and a halogenated salt used as catalyst to prepare a powder mixture, and then the article to be treated is embedded in this powder mixture and heated to a temperature within the range of 950° to 1,100° C in an inert gas atmosphere, with the chromium halide produced being subjected to a substitution and reduction reaction to precipitate chromium. This method is indeed advantageous over the aforesaid vapor-phase TiC plating method in that the process is easy and the apparatus used for the process is simple, but the hardness of the hardened layer obtained from this method is within the range of approximately 1,600 to 1,800 in micro-Vickers hardness (Hv), and hence this method has a problem in providing satisfactorily high wear resistance.

In order to solve this problem, the present inventor has previously proposed, in Japanese Patent Application No. 17284/1974, corresponding to U.S. application Ser. No. 548,971 a case-hardening method for carburizing the surface of carbon steel according to a solid powder method by using a powder mixture consisting of titanium, chromium, alumina and catalyst. The present invention is an expansion of this conception and features employment of chromium trioxide $Cr_2O_3$ as the chromium supply source. When a mixture where $Cr_2O_3$ and Ti coexist is heated to a high temperature, titanium oxide $TiO_2$ is produced from the relation of thermal equilibrium, but during this process, there is also produced chromium in the nascent state. To put it more specifically, the relation between standard free energy and temperature in the formation of oxides is given by the following formula from the thermodynamic quantities:

$$\Delta G^\circ = \Delta H^\circ - T\Delta S^\circ$$

where $\Delta G^\circ$, $\Delta H^\circ$ and $\Delta S^\circ$ are the values of standard free energy, enthalpy and entropy, respectively, at a certain temperature and under pressure of 1 atmosphere. In the generally used reactions, such relation is given by the following formula: $\Delta G^\circ = a + bT \cdot \log T + CT$. Thus, it is possible to know the free energy of formation at a certain temperature, but this value can be used also for assessing relative stability of the oxide contacted with the metal. That is, the more negative the free energy is, the more stable is the oxide.

Considering here the relation between Ti and Cr, it is learned from said formula that the Ti oxide is more stable at any temperature. Supposing that $Cr_2O_3$ and Ti are contacted with each other at 1,000° C, the following formulae hold:

$$Ti(S) + O_2(g, 1\ atm) = TiO_2(S)\ \Delta G^\circ = -161\ Kcal \quad (1)$$

$$4/3Cr + O_2(g,\ 1\ atm) = \tfrac{2}{3}\ Cr_2O_3(S)\ \Delta G^\circ = -126\ Kcal \quad (2)$$

From formulae (1) and (2), the following formula (3) is obtained:

$$Ti + \tfrac{2}{3}\ Cr_2O_3 = 4/3\ Cr + TiO_2\ \Delta G^\circ = -35\ Kcal \quad (3)$$

In the formula (3), the reaction proceeds to the right side to produce Cr.

The method of the present invention utilizes this nascent chromium. The hardened TiC surface layer obtained from the method of the present invention has metallic luster, excellent adhesiveness and great thickness amounting to approximately 50 $\mu$.

Essentially, the method of the present invention is characterized by using chromium oxide powder and titanium oxide powder as the diffused metal source, adding thereto a halogenated salt as catalyst to prepare the powder mixture, embedding carbon steel in this powder mixture, and subjecting same to a heat treatment at 900° to 1,100° C in an atmosphere of an inert gas such as hydrogen or argon gas.

The mixing ratio of metallic titanium and chromium oxide in the powder mixture for forming the desired carbide layer according to the method of the present invention varies depending on the particle sizes of said mixing substances used, and it is hard to define such mixing ratio within a certain specified range. In case, for instance, the particle size of both of said substances is −400 meshes, if the mixing ratio of chromium oxide is less than 15 weight % of metallic titanium powder, no effect of chromium comes out and the hardened layer is subject to wear-off, and there is formed low-grade titanium carbide of low hardness (less than 2,000 Hv). If chromium oxide is mixed in an amount of over 50 weight %, there is formed a hardened layer where chromium carbide is present in titanium carbide, and if the mixing ratio of chromium oxide exceeds 70 weight %, the resultant hardened layer is substantially composed of chromium carbide. It is thus found that in case the particle size of the mixed substances is −400 meshes, there can be formed an excellent thick titanium carbide layer with hardness of approximately 3,000 or higher when chromium oxide is blended in an amount of 20 to 60 weight % of metallic titanium powder.

If heating in the heating treatment is practiced at a higher temperature and for a longer time, the tendency to form the chromium carbide layer is still strengthened, and although the inside of the hardened layer is substantially composed of titanium carbide, formation of chromium carbide is seen in the outermost surface layer. The hardened layer is also affected by the type of the catalyst used. For instance, in case of using a halogenated metal at a lower temperature, or in case of using a fluoride type substance (such as potassium borofluoride) or a bromide type substance (such as ammonium bromide) having high vapor pressure, the tendency to form chromium carbide in the outermost surface layer is strengthened.

The results of the experiments have shown that when using as catalyst a chloride type substance such as for example hydrazine chloride $N_2H_4$. HCl or ammonium chloride $NH_4Cl$, it is possible to obtain a hardened layer where a uniform titanium carbide layer extends over the thickness of about 50 $\mu$, and high hardness of 3650 Hv in micro-Vickers hardness under 1 Kg load was observed. Also, such layer showed no sign of wear-off even when subjected to quenching after the treatment.

According to the method of the present invention, it is possible to form a thick hardened layer in a short treating time by using a simple apparatus, and also the treating powders used show no solidifying disposition and hence they can be easily pulverized and reused by again adding a suitable amount of titanium, chromium oxide, catalyst and/or other additives required.

EXAMPLE 1

−400-mesh chromium trioxide $Cr_2O_3$ was blended in −400-mesh titanium powder in an amount of 10 to 80 weight % of the amount of titanium, and 10 weight % of ammonium chloride $NH_4Cl$ was further added thereto as catalyst, thereby forming powder mixtures. These powder mixtures were placed in the separate steel-made containers respectively, and then a 10 × 20 × 1.5 mm tool steel SK4 material was embedded in the powder mixture in each of said containers and heated at 1,050° C for two hours in an argon atmosphere.

Figure 1:
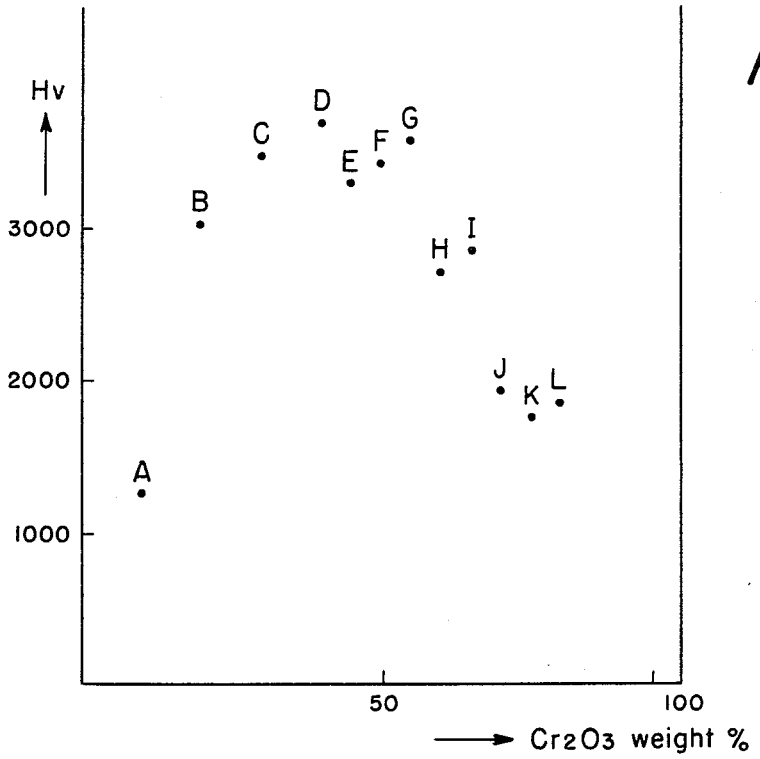
FIG. 1 is a graph showing the surface hardness of the materials treated according to a method of the present invention, with the abscissa being measured as weight % of $Cr_{23}O_3$ to titanium and the ordinate as micro-Vickers hardness Hv.

The surface hardness of each of the thus treated materials was measured, with the results being shown in FIG. 1. As seen from this figure, the peak hardness of from 3,300 to 3,700 Hv is obtained with the powder mixtures C, D, E, F and G where the blending ratio of $Cr_2O_3$ is 30, 40, 45, 50 and 55 weight %, respectively. It is also noted that powder mixture B blended with 20 weight % of $Cr_2O_3$ can produce high hardness of 3,050 Hv, and also powder mixtures H and I containing 60 and 65 weight % of $Cr_2O_3$, respectively, provide high hardness of 2,700 and 2,850 Hv respectively. In the case of mixture A, where the blending ratio of $Cr_2O_3$ was 10 weight % and mixtures J, K and L, where said ratio was over 70 weight %, surface hardness was less than 2,000 Hv.

EXAMPLE 2

Figure 2:
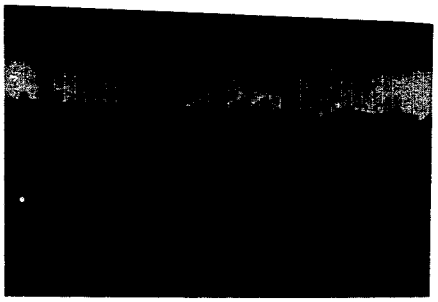
FIGS. 2 and 3 are sectional microphotographs of the treated materials, with FIG. 2 showing the material treated by a powder mixture where the $Cr_2O_3$/Ti weight ratio is 70 : 30 and FIG. 3 showing the material treated by a powder mixture where said ratio is 30 : 70.

There were prepared a powder mixtures which are exactly the same as those in Example 1 except that −400-mesh $Cr_2O_3$ was mixed such that its ratio to Ti is 70 : 30 by weight, and a tool steel SK4 material was embedded in said powder mixture and treated in the same way as Example 1. FIG. 2 is a microphotograph showing a section of the thus treated material.

Figure 3:
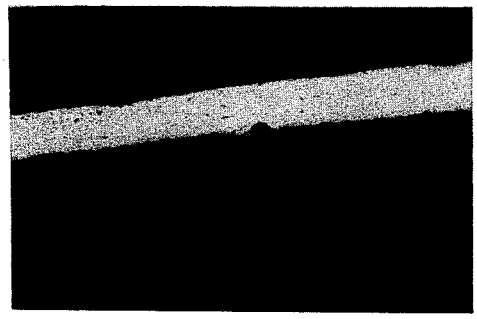

There were also prepared powder mixtures exactly the same as those in Example 1 except that the mixing ratio of −400-mesh $Cr_2O_3$ to Ti was 30 : 70 by weight, and a tool steel SK4 material was embedded in this powder mixture and treated in the same way described above. FIG. 3 is a micro-photograph showing a section of the thus treated material.

Examinations of these treated materials by X-ray diffraction revealed that the surface layer of the material shown in FIG. 2 is a hardened layer of chromium carbide $Cr_{23}C_6$ while the surface layer of the material shown in FIG. 3 is a thick and compact TiC layer.

EXAMPLE 3

−400-mesh chromium trioxide $Cr_2O_3$ was blended with −400-mesh Ti powder in an amount of 30 weight % of the amount of Ti, and to this was added 10 weight % of $NH_4Cl$, as the catalyst to prepare a powder mixture M, the same amount of $N_2H_4$.HCl to prepare powder mixture N, the same amount of $NH_4Br$ to prepare powder mixture P, and the same amount of $KBF_4$ to prepare powder mixture Q, respectively. These powder mixtures were put in respective steel-made containers, and then the 10 × 20 × 1.5 mm tool steel SK4 materials were embedded in said respective powder mixtures and heated at 1,050° C in an argon atmosphere by varying the heating time from 1 to 5 hours.

Figure 4:
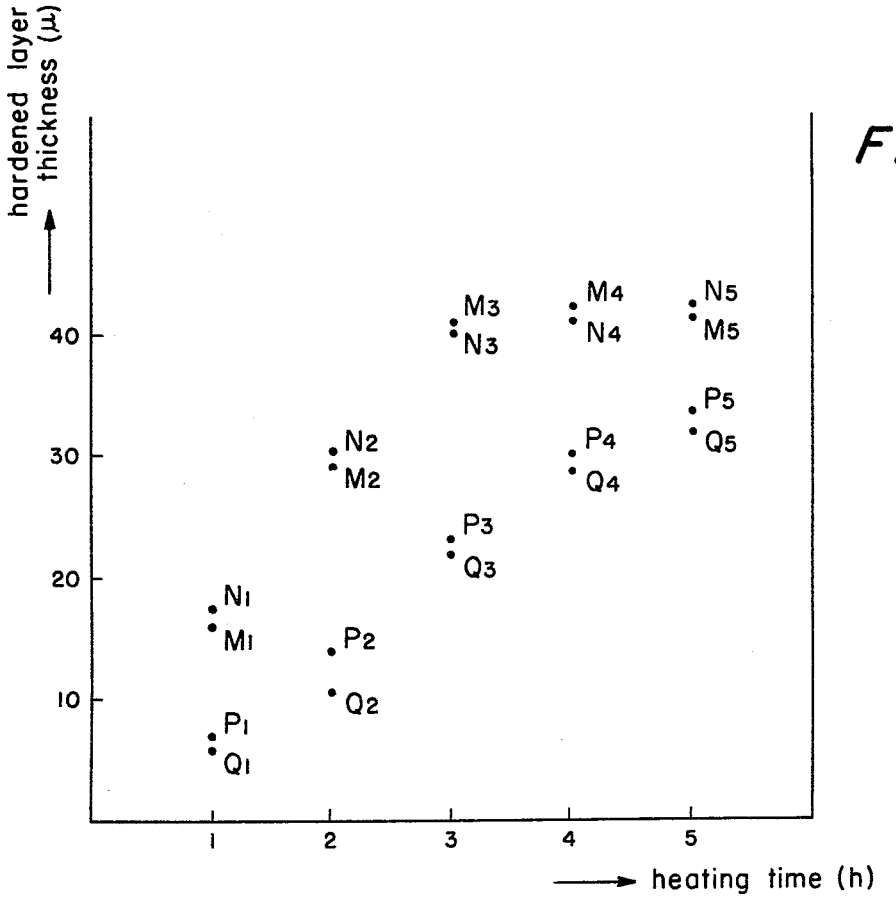
FIG. 4 is a graph showing the ralationship between the treating conditions and thickness of the hardened layers, where the abscissa is measured as heating time (h) and the ordinate as hardened layer thickness ($\mu$).

The sections of the thus treated materials were observed microscopically to measure the hardened layer thickness. FIG. 4 is a graph showing the results of measurements, with the vertical axis representing hardened layer thickness ($\mu$) and the horizontal axis representing heating time (hr). $M_1$ signifies the material which was heated for one hour in the powder mixture M. Similar representation is intended by other letters bearing a subscript. As noticed from this graph, in the case of materials $M_3$ and $N_3$ which have been heated for three hours in the powder mixtures M and N using $NH_4Cl$ and $N_2H_4Cl$ as catalyst, respectively, the substantial portion of carbon in the inside of the material is settled in the surface by dint of Ti, while in the case of $M_4$, $M_5$, $N_4$ and $N_5$ which have been heated longer than three hours, no expansion of the hardened layer takes place. It is seen, however, that the hardened layer expands with time in the materials treated with powder mixtures P and Q using $NH_4Br$ and $KBF_4$ as catalyst, respectively.

Figure 5:
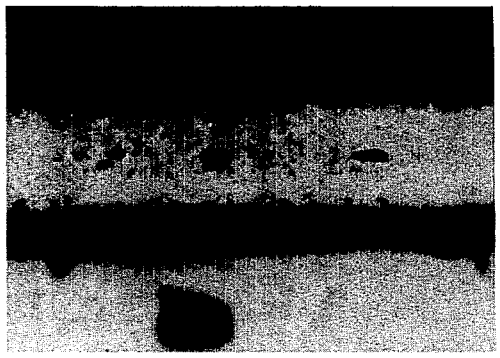
FIGS. 5 and 6 are sectional microphotographs showing the difference in the hardened layer according to the type of the catalyst used, with FIG. 5 showing a section of the material treated by a powder mixture using $NH_4Cl$ as catalyst and FIG. 6 showing a section of the material treated by a powder mixture using $NH_4Br$ as catalyst.
Figure 6:
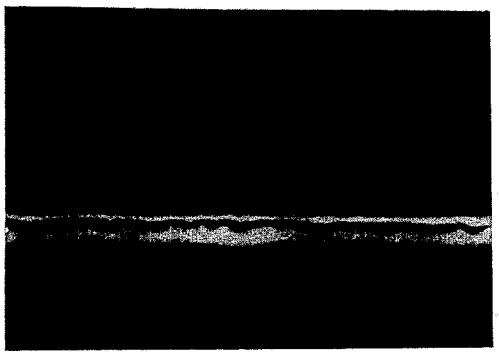

FIGS. 5 and 6 are sectional microphotographs of the material $M_3$ which has been heated at 1,050°-C for three hours in a powder mixture using $NH_4Cl$ as catalyst and the material $P_3$ which has been heated at 1,050° C for three hours in a powder mixture using $NH_4Br$ as catalyst, respectively. The results of these microscopic observations and X-ray diffraction tests have revealed that, in the case of $M_3$, a TiC layer exists in the outermost surface layer and $Cr_{23}C_6$ is present sporadically in the inside, while in the case of $P_3$, TiC is precipitated in the inside of the hardened layer and $Cr_{23}C_6$ in the outermost surface layer.

What is claimed is:

1. A case-hardening method for carbon steel in the metallic cementation thereof according to a solid powder method, comprising the steps of preparing a powder mixture by combining a halogenated salt as catalyst with titanium powder and chromium oxide powder, embedding carbon steel in said powder mixture and subjecting the resultant mixture to a heat treatment to thereby form a carbide hardened layer mainly composed of titanium carbide, wherein the proportion of said chromium oxide in said mixture is sufficient to provide said carbon steel with a uniformly thick layer of titanium carbide having an hardness of approximately at least 3000 Hv.

2. A case-hardening method according to claim 1 in which said resultant mixture is subjected to a heat treatment at about 900° to 1,100° C. in an inert atmosphere.

3. A case-hardening method according to claim 2 in which the particle size of said powder mixture is about −400 mesh and said powder mixture contains said chromium oxide in an amount of about 20 to 60% by weight of said titanium.

4. A case hardening method according to claim 1 in which said catalyst is a chloride salt.

5. A case-hardening method for carbon steel in the metallic cementation thereof according to a solid powder method comprising preparing a powder mixture by combining a halogenated salt, as catalyst with titanium powder and chromium oxide powder, said chromium oxide powder being present in an amount of about 20% to 60% by weight of said titanium powder, embedding said carbon steel in said powder mixture and subjecting the resulting mixture to a heat treatment to thereby form a carbide hardened layer mainly composed of titanium carbide.

6. A case-hardening method according to claim 5 in which said resultant mixture is subjected to a heat treatment at about 900° to 1,100° C. in an inert atmosphere.

7. A case-hardening method according to claim 5 in which the particle size of said powder mixture is about −400 mesh.

8. A case-hardening method according to claim 5 in which said catalyst is a chloride salt.

* * * * *